US011398209B2

(12) United States Patent
Li

(10) Patent No.: US 11,398,209 B2
(45) Date of Patent: Jul. 26, 2022

(54) CLAMPING MECHANISM FOR GUITAR CAPO

(71) Applicant: SHENZHEN FZONE TECHNOLOGY CO., LTD., Shenzhen (CN)

(72) Inventor: Wei Li, Shenzhen (CN)

( * ) Notice: Subject to any disclaimer, the term of this patent is extended or adjusted under 35 U.S.C. 154(b) by 166 days.

(21) Appl. No.: 16/763,512

(22) PCT Filed: Nov. 18, 2019

(86) PCT No.: PCT/CN2019/119238
§ 371 (c)(1),
(2) Date: May 12, 2020

(87) PCT Pub. No.: WO2021/072888
PCT Pub. Date: Apr. 22, 2021

(65) Prior Publication Data

US 2021/0407469 A1 Dec. 30, 2021

(30) Foreign Application Priority Data

Oct. 16, 2019 (CN) ..... 201910981300.5

(51) Int. Cl.
*G10D 3/053* (2020.01)

(52) U.S. Cl.
CPC ..... *G10D 3/053* (2020.02)

(58) Field of Classification Search
CPC ..... G10D 3/053
See application file for complete search history.

(56) References Cited

U.S. PATENT DOCUMENTS 4,324,165 A * 4/1982 Wilkerson ..... G10D 3/053 84/318
5,492,045 A * 2/1996 Roblee ..... G10D 3/053 84/318

(Continued)

FOREIGN PATENT DOCUMENTS

CN 104810009 7/2015

*Primary Examiner* — Robert W Horn
(74) *Attorney, Agent, or Firm* — Scarinci Hollenbeck LLC; Libby Babu Varghese

(57) ABSTRACT

The present application discloses a clamping mechanism for a guitar capo, including an upper clamp (1) and a lower clamp (9). A slider rail (2) is fixedly installed inside the upper clamp (1), a rebound torsion spring fixing pin (3) is fixedly installed inside the slider rail (2), and a rebound torsion spring (4) is fixedly installed inside the slider rail (2) by the rebound torsion spring fixing pin (3). A crank hinge (6) is fixedly installed inside the slider rail (2). The clamping mechanism of the guitar capo is provided with the lower clamp (9), and the cam structure on the right side of the lower clamp (9) is stuck and cannot move the self-locking slider (7) in the opposite direction, thus the lower clamp (9) cannot rotate in the opposite direction, thereby achieving locking effect and completing locking and clamping. By providing with the unlocking handle (5), the unlocking handle (5) drives the self-locking slider (7) to slide to unlock the locking of the cam mechanism of the lower clamp, thereby effectively achieving the effect of quickly installing the capo on the guitar strings and improving the self-locking effect of the capo.

11 Claims, 2 Drawing Sheets

(56) References Cited

U.S. PATENT DOCUMENTS

| | | | | |
|---|---|---|---|---|
| 6,008,441 | A * | 12/1999 | Steinberger | G10D 3/053 84/318 |
| 7,968,778 | B2 * | 6/2011 | D'Addario | G10D 3/053 84/312 R |
| 9,754,563 | B1 * | 9/2017 | Chen | G10D 3/053 |
| 9,953,622 | B2 * | 4/2018 | Campling | G10G 1/04 |
| 10,229,660 | B2 * | 3/2019 | Miyajima | G10D 3/053 |
| 10,418,007 | B2 * | 9/2019 | Park | B65D 5/00 |
| 2021/0407469 | A1 * | 12/2021 | Li | G10D 3/053 |

* cited by examiner

CLAMPING MECHANISM FOR GUITAR CAPO

PRIORITY CLAIM

The present application claims priority to Chinese Patent Application No, 201910981300.5, filed on Oct. 16, 2019, the entire disclosure of which is incorporated herein by reference.

TECHNICAL FIELD

The present application relates to the field of guitar accessories, and in particular to a clamping mechanism for a guitar capo.

BACKGROUND

The capo was originally used to adjust the pitch of the guitar. It is a commonly used auxiliary tool in the folk guitar playing and singing. When changing the pitch, the capo can press the frets to increase the tune by a corresponding interval while playing with the original fingering, so that the tune is in harmony with the singer's voice, which greatly reduces the difficulty of changing the pitch, and now the capo is widely used in the performance of flamenco guitar, classical guitar and folk guitar.

A guitar capo with damper function has been proposed in the Chinese authorized invention CN201510216102.1, the beneficial effect of which is that the damper function can be exerted by pressing the strings with cotton layer, and it also has a pitch change and damper function. But the traditional capo can only be adapted for a guitar with single-sized fingerboard, when the player changes a guitar of a different type, the capo needs to be re-adjusted, so guitar lovers need to purchase a lot of capos to fit different guitars, and each time after changing the guitar, it takes much long time to find the right capo in many types of capos. Different capos have different clamping forces and therefore have small application range. The clamping force of the spring-type capo is difficult to guarantee and is not adjustable, and the capos operated in screw tightening mode have complicated operation and short service life. Therefore, a clamping mechanism of the guitar capo is proposed.

Technical Problems

One of the objects of the embodiments of the present application is to provide a clamping mechanism for a guitar capo, the clamping mechanism is convenient for the user to use at any time and suitable for different types of guitars, which increases the ability of the human hand to freely control the clamping force and therefore solves the following problems: the traditional capo can only be adapted for a guitar with single-sized fingerboard, the capo needs to be re-adjusted when the player changes a guitar of a different type, and each time after changing the guitar, it takes much long time to find the right capo in many types of capos.

Technical Solutions

To solve the above technical problems, a technical solution adopted by the embodiment of the present application is as follows:

A clamping mechanism for a guitar capo is provided, comprising an upper clamp and a lower clamp; a slider rail is fixedly installed inside the upper clamp, a rebound torsion spring fixing pin is fixedly installed inside the slider rail, and a rebound torsion spring is fixedly installed inside the slider rail by the rebound torsion spring fixing pin; a crank hinge is fixedly installed inside the slider rail, and an unlocking handle is hinged with the slider rail through the crank hinge; a self-locking slider is movably installed at the bottom of the slider rail, and a crank slider pin is fixedly installed inside the self-locking slider; the side of the lower clamp adjacent to the upper clamp is fixedly installed with a protective pad, and a lower fixing pin is hinged inside the lower clamp; a reset torsion spring is sleeved on the outer side of the lower fixing pin and on the front side of the lower clamp, the front side of the lower clamp defines a limiting hole, and a limiting pin extending through the limiting hole is fixedly installed inside the upper clamp.

Preferably, the upper clamp and the lower clamp form a clamping hinge structure by the lower fixing pin, the protection pad is elastic silicone, and the end of the unlocking handle away from the crank slider pin extends to the outside of the top of the upper clamp.

Preferably, the slider rail is fixedly installed at the body of the upper clamp, the crank slider pin is fixedly installed on the slider rail and forms a sliding mechanism together with the unlocking handle.

Preferably, the unlocking handle is hinged with the slider rail through the crank hinge to form a crank slider mechanism.

Preferably, the end of the rebound torsion spring away from the slider rail is in contact with the unlocking handle, and the limiting hole extends through the lower clamp.

Preferably, the lower clamp has a cam structure on one side, and the bottom of the self-locking slider contacts with the cam structure of the lower clamp to form a cam mechanism.

Preferably, a sliding slot is arranged at the bottom of the slider rail, and the self-locking slider is movably installed inside the sliding slot to form a slider mechanism.

Preferably, the unlocking handle forms a crank slider mechanism together with the self-locking slider through the crank slider pin, and the lower clamp is movably installed at the bottom of the upper clamp and below the self-locking slider.

Preferably, the limiting pin is movably installed inside the limiting hole on the lower clamp, so that the rotation range of the lower clamp is limited by the size of the limiting hole.

Beneficial Effects

Compared with the prior art, the present application provides a clamping mechanism for a guitar capo with the following beneficial effects:

1. The clamping mechanism for the guitar capo is provided with the lower clamp. In an initial state, the left side of upper clamp and the lower clamp are pressed inward by hand, so that the lower clamp is rotated around the lower fixing pin to reduce the distance between the upper clamp and the lower clamp, so as to press the guitar string, while the unlocking handle is rotated clockwise around the crank hinge under the action of the rebound torsion spring, thereby, below the slider rail, pressing the self-locking slider towards the left through the bottom of the unlocking handle. After the guitar string is pressed, the protective pad on the lower clamp provides elastic force for clamping the guitar string due to extrusion deformation. After the hand stops pressing, the lower clamp has a tendency to rotate in the opposite direction under the action of the deformed protective pad and the reset torsion spring, however, since the right side of the lower clamp presents cam-shaped, it will be squeezed and stuck by the self-locking slider, so that it cannot be driven to move in the opposite direction. The cam structure on the right side of the lower clamp is stuck and can't drive the self-locking slider to move in the opposite direction, the lower clamp can't rotate in the opposite direction, thereby achieving a locking effect and completing locking and clamping. By providing with the unlocking handle, the unlocking handle drives the self-locking slider to slide and unlock the locking of the cam mechanism of the lower clamp, the effect of quickly installing the capo on the guitar string is effectively achieved, and the self-locking effect of the capo is improved.

2. The clamping mechanism for the guitar capo is provided with the unlocking handle 5. In the clamped state, the unlocking handle is pressed downwardly by hand, so that the unlocking handle is rotated towards the right around the crank hinge. When the unlocking handle is driven to move towards the right, below the slider rail, the self-locking slider will be moved towards the right. Since the restriction from the self-locking slider disappears, the reset torsion spring will drive the lower clamp to rotate around the lower fixing pin, thereby increasing the distance between the upper clamp and the lower clamp to release the guitar fingerboard, and returning to the initial state with unlocking completed, the effect of quickly unlocking is effectively achieved, and the capo can be quickly removed when the guitar does not need the capo.

DRAWINGS

In order to more clearly illustrate the technical solutions in the embodiments of the present application, the drawings to be used in the embodiments or exemplary technical description will be briefly described below. It is obvious that the drawings described in the following are only some embodiments of the present application, and for those of ordinary skill in the art, other drawings may be obtained according to these drawings without paying creative work.

In the figures: 1—upper clamp, 2—slider rail, 3—rebound torsion spring fixing pin, 4—rebound torsion spring, 5—unlocking handle, 6—crank hinge, 7—self-locking slider, 8—crank slider pin, 9—lower clamp, 10—protective pad, 11—lower fixing pin, 12—reset torsion spring, 13—limiting hole, 14—limiting pin.

EMBODIMENTS OF THE INVENTION

In order to make the objects, technical solutions, and advantages of the present application more comprehensible, the present application will be further described in detail below with reference to the drawings and embodiments. It is to be understood that the specific embodiments described herein are for the explanation of the invention only and are not intended to limit the present application.

Figure 1:
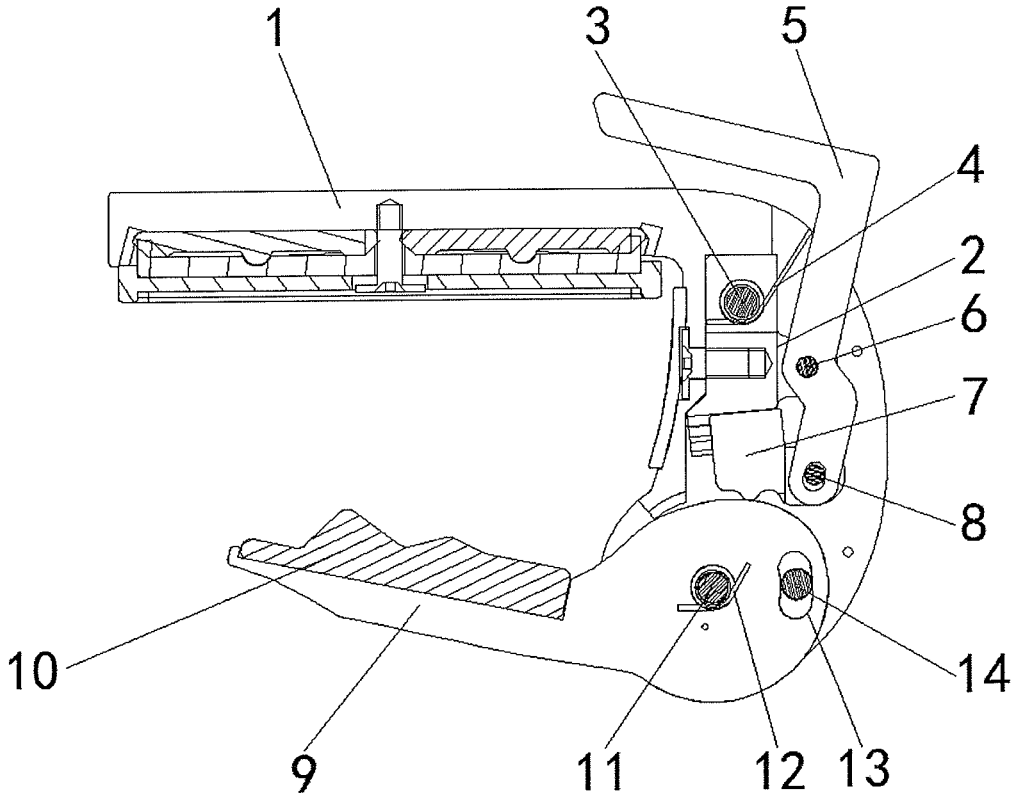
FIG. 1 is a schematic view showing the structure of a clamping mechanism for a guitar capo according to the present application.
Figure 2:
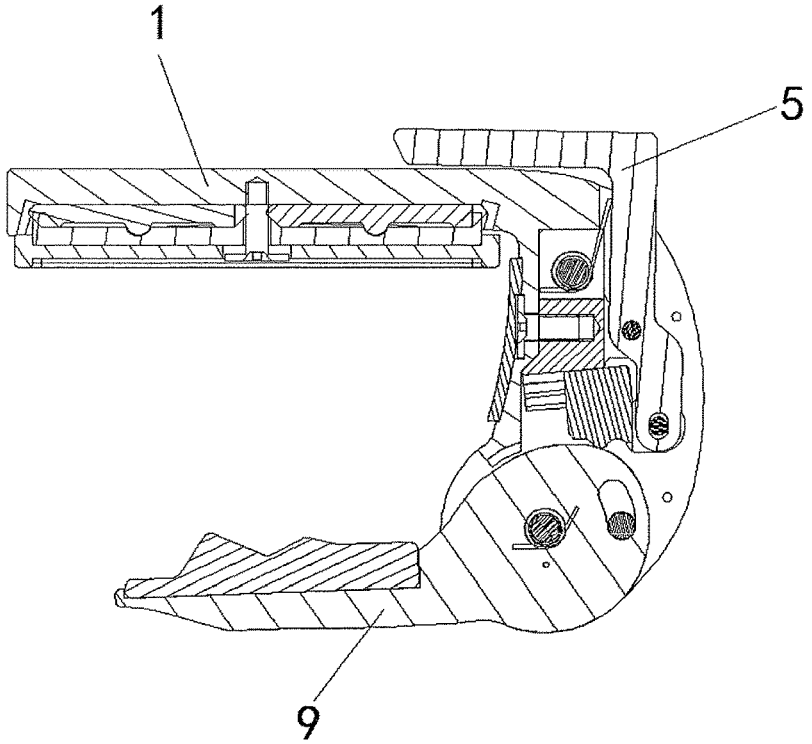
FIG. 2 is a schematic view showing the initial state of a clamping mechanism for a guitar capo according to the present application.
Figure 3:
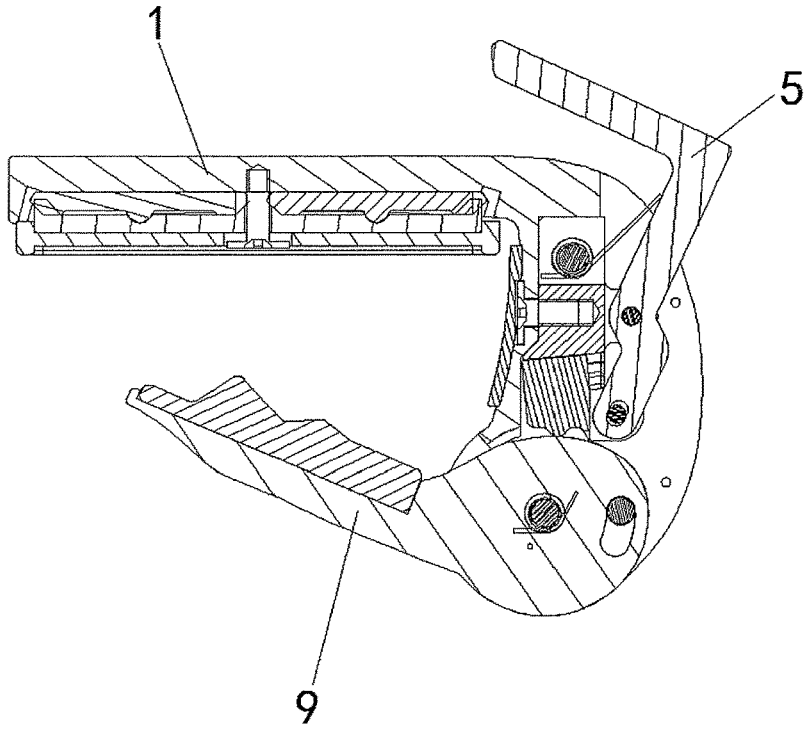
FIG. 3 is a schematic view showing the clamping state of a clamping mechanism for a guitar capo according to the present application.

Referring to FIG. 1-3, a clamping mechanism for a guitar capo includes an upper clamp 1 and a lower clamp 9. The upper clamp 1 is fixedly installed with a slider rail 2 therein, the slider rail 2 is fixedly installed with a rebound torsion spring fixing pin 3 therein, the slider rail 2 is fixedly installed with a rebound torsion spring 4 therein by the rebound torsion spring fixing pin 3, and a crank hinge 6 is fixedly installed inside the slider rail 2. An unlocking handle 5 is hinged with the slider rail 2 through the crank hinge 6 to form a crank slider mechanism, and the slider rail 2 is hinged with the unlocking handle 5 via the crank hinge 6. A self-locking slider 7 is movably installed at the bottom of the slider rail 2, a sliding slot is formed at the bottom of the slider rail 2, and the self-locking slider 7 is movably installed inside the sliding slot to form a slider mechanism. A crank slider pin 8 is fixedly installed inside the self-locking slider 7, the slider rail 2 is fixed at the body of the upper clamp 1, and the crank slider pin 8 is fixedly installed on the slider rail 2 and forms a sliding mechanism together with the unlocking handle 5. The side of the lower clamp 9 adjacent to the upper clamp 1 is fixedly installed with a protective pad 10, and the lower clamp 9 presents a cam structure on one side, and the bottom of the self-locking slider 7 is in contact with the cam structure of the lower clamp 9 to form a cam mechanism. The unlocking handle 5 forms the crank slider mechanism together with the self-locking slider 7 through the crank slider pin 8. The lower clamp 9 is movably installed at the bottom of the upper clamp 1 and below the self-locking slider 7. A lower fixing pin 11 is hinged inside the lower clamp 9, and the upper clamp 1 and the lower clamp 9 form a clamping hinge structure through the lower fixing pin 11. The protective pad 10 is elastic silicone. The end of the unlocking handle 5 away from the crank slider pin 8 extends to the outside of the top of the upper clamp 1. A reset torsion spring 12 is sleeved on the outer side of the lower fixing pin 11 and on the front side of 9. In an initial state, the left side of upper clamp 1 and the lower clamp 9 are pressed inward by hand, so that the lower clamp 9 is rotated around the lower fixing pin 11 to reduce the distance between the upper clamp 1 and the lower clamp 9, so as to press the guitar string, while the unlocking handle 5 is rotated clockwise around the crank hinge 6 under the action of the rebound torsion spring 4, thereby, below the slider rail 2, pressing the self-locking slider 7 towards the left through the bottom of the unlocking handle 5. After the guitar string is pressed, the protective pad 10 on the lower clamp 9 provides elastic force for clamping the guitar string due to extrusion deformation. After the hand stops pressing, the lower clamp 9 has a tendency to rotate in the opposite direction under the action of the deformed protective pad 10 and the reset torsion spring 12, however, since the right side of the lower clamp 9 presents cam-shaped, it will be squeezed and stuck by the self-locking slider 7, so that it cannot be driven to move in the opposite direction. The cam structure on the right side of the lower clamp 9 is stuck and can't drive the self-locking slider 7 to move in the opposite direction, the lower clamp 9 can't rotate in the opposite direction, thereby achieving a locking effect and completing locking and clamping. By providing with the unlocking handle 5, the unlocking handle 5 drives the self-locking slider 7 to slide and unlock the locking of the cam mechanism of the lower clamp 9, the effect of quickly installing the capo on the guitar string is effectively achieved, and the self-locking effect of the capo is improved. The front side of the lower clamp 9 defines a limiting hole 13, the end of the rebound torsion spring 4 away from the slider rail 2 is in contact with the unlocking handle 5, and the limiting hole 13 extends through the lower clamp 9. And a limiting pin 14 is movably installed inside the limiting hole 13 on the lower clamp 9, so that the rotation range of the lower clamp 9 is limited by the size of the limiting hole 13. The limiting pin 14 extending through the limiting hole 13 is fixedly installed inside the upper clamp 1. In the clamped state, the unlocking handle 5 is pressed downwardly by hand, so that the unlocking handle 5 is rotated towards the right around the crank hinge 6. When the unlocking handle 5 is driven to move towards the right, below the slider rail 2, the self-locking slider 7 will be moved towards the right. Since the restriction from the self-locking slider 7 disappears, the reset torsion spring 12 will drive the lower clamp 9 to rotate around the lower fixing pin 11, thereby increasing the distance between the upper clamp 1 and the lower clamp 9 to release the guitar fingerboard, and returning to the initial state with unlocking completed, the effect of quickly unlocking is effectively achieved, and the capo can be quickly removed when the guitar does not need the capo.

In use, in an initial state, the left side of upper clamp 1 and the lower clamp 9 are pressed inward by hand, so that the lower clamp 9 is rotated around the lower fixing pin 11 to reduce the distance between the upper clamp 1 and the lower clamp 9, so as to press the guitar string, while the unlocking handle 5 is rotated clockwise around the crank hinge 6 under the action of the rebound torsion spring 4, thereby, below the slider rail 2, pressing the self-locking slider 7 towards the left through the bottom of the unlocking handle 5. After the guitar string is pressed, the protective pad 10 on the lower clamp 9 provides elastic force for clamping the guitar string due to extrusion deformation. After the hand stops pressing, the lower clamp 9 has a tendency to rotate in the opposite direction under the action of the deformed protective pad 10 and the reset torsion spring 12, however, since the right side of the lower clamp 9 presents cam-shaped, it will be squeezed and stuck by the self-locking slider 7, so that it cannot be driven to move in the opposite direction. The cam structure on the right side of the lower clamp 9 is stuck and can't drive the self-locking slider 7 to move in the opposite direction, the lower clamp 9 can't rotate in the opposite direction, thereby achieving a locking effect and completing locking and clamping. By providing with the unlocking handle 5, the unlocking handle 5 drives the self-locking slider 7 to slide and unlock the locking of the cam mechanism of the lower clamp 9. In the clamped state, the unlocking handle 5 is pressed downwardly by hand, so that the unlocking handle 5 is rotated towards the right around the crank hinge 6. When the unlocking handle 5 is driven to move towards the right, below the slider rail 2, the self-locking slider 7 will be moved towards the right. Since the restriction from the self-locking slider 7 disappears, the reset torsion spring 12 will drive the lower clamp 9 to rotate around the lower fixing pin 11, thereby increasing the distance between the upper clamp 1 and the lower clamp 9 to release the guitar fingerboard, and returning to the initial state with unlocking completed, the effect of quickly unlocking is effectively achieved, and the capo can be quickly removed when the guitar does not need the capo.

In summary, the clamping mechanism for the guitar capo is provided with the lower clamp 9. In an initial state, the left side of upper clamp 1 and the lower clamp 9 are pressed inward by hand, so that the lower clamp 9 is rotated around the lower fixing pin 11 to reduce the distance between the upper clamp 1 and the lower clamp 9, so as to press the guitar string, while the unlocking handle 5 is rotated clockwise around the crank hinge 6 under the action of the rebound torsion spring 4, thereby, below the slider rail 2, pressing the self-locking slider 7 towards the left through the bottom of the unlocking handle 5. After the guitar string is pressed, the protective pad 10 on the lower clamp 9 provides elastic force for clamping the guitar string due to extrusion deformation. After the hand stops pressing, the lower clamp 9 has a tendency to rotate in the opposite direction under the action of the deformed protective pad 10 and the reset torsion spring 12, however, since the right side of the lower clamp 9 presents cam-shaped, it will be squeezed and stuck by the self-locking slider 7, so that it cannot be driven to move in the opposite direction. The cam structure on the right side of the lower clamp 9 is stuck and can't drive the self-locking slider 7 to move in the opposite direction, the lower clamp 9 can't rotate in the opposite direction, thereby achieving a locking effect and completing locking and clamping. By providing with the unlocking handle 5, the unlocking handle 5 drives the self-locking slider 7 to slide and unlock the locking of the cam mechanism of the lower clamp 9, the effect of quickly installing the capo on the guitar string is effectively achieved, and the self-locking effect of the capo is improved. By providing with the unlocking handle 5, in the clamped state, the unlocking handle 5 is pressed downwardly by hand, so that the unlocking handle 5 is rotated towards the right around the crank hinge 6. When the unlocking handle 5 is driven to move towards the right, below the slider rail 2, the self-locking slider 7 will be moved towards the right. Since the restriction from the self-locking slider 7 disappears, the reset torsion spring 12 will drive the lower clamp 9 to rotate around the lower fixing pin 11, thereby increasing the distance between the upper clamp 1 and the lower clamp 9 to release the guitar fingerboard, and returning to the initial state with unlocking completed, the effect of quickly unlocking is effectively achieved, and the capo can be quickly removed when the guitar does not need the capo. The problem that the traditional capo can only be adapted for a guitar with single-sized fingerboard, and the problem that the capo needs to be re-adjusted when the player changes a guitar of a different type and it takes much long time to find the right capo in many types of capon each time after changing the guitar are solved.

It should be noted that, in this application, relational terms such as first and second are used merely to distinguish one element or operation from another element or operation, and do not necessarily require or imply any such actual relationship or order between these elements or operations. Furthermore, the term "comprise" or "include" or any other variations thereof is intended to encompass a non-exclusive inclusion, such that a process, method, article, or device that comprises a plurality of elements includes not only those elements but also other elements not explicitly listed, or the elements inherent in such process, method, article or device. Without further restrictions, the element that is defined by the phrase "comprising a/an" or the like does not exclude the presence of additional equivalent elements in the process, method, article, or device that comprises said element.

The above are only alternative embodiments of the present application and are not intended to limit the present application. Various modifications and variations can be made to the present application by those of ordinary skill in the art. Any modifications, equivalent substitutions and improvements made within the spirit and principle of the present application are intended to be included within the scope of the appended claims.

What is claimed is:

1. A clamping mechanism for a guitar capo, comprising: an upper clamp (1), the upper clamp having a slider rail (2), a rebound torsion spring fixing pin (3) disposed inside the slider rail (2), and a rebound torsion spring (4) disposed around the rebound torsion spring fixing pin (3); a crank hinge (6) disposed inside the slider rail (2), and an unlocking handle (5) hinged with the slider rail (2) through the crank hinge (6); a self-locking slider (7) is movably installed at the bottom of the slider rail (2), and a crank slider pin (8) is disposed inside the self-locking slider (7); and a lower clamp (9), a side of the lower clamp (9) adjacent to the upper clamp (1) is disposed with a protective pad (10), and a lower fixing pin (11) is hinged inside the lower clamp (9); a reset torsion spring (12) is sleeved on the outer side of the lower fixing pin (11) and on a front side of the lower clamp (9), the front side of the lower clamp (9) defining a limiting hole (13), and a limiting pin (14) extending through the limiting hole (13) is disposed inside the lower clamp (9).

2. The clamping mechanism for a guitar capo according to claim 1, wherein the upper clamp (1) and the lower clamp (9) form a clamping hinge structure through the lower fixing pin (11), the protection pad (10) is elastic silicone, and an end of the unlocking handle (5) away from the crank slider pin (8) extends to the outside of the top of the upper clamp (1).

3. The clamping mechanism for a guitar capo according to claim 1, wherein the slider rail (2) is disposed in the upper clamp (1), is disposed on the slider rail (2), the crank slider pin (8) and said unlocking handle (5) forming a sliding mechanism.

4. The clamping mechanism for a guitar capo according to claim 1, wherein the unlocking handle (5) is hinged with the slider rail (2) through the crank hinge (6) to form a crank slider mechanism.

5. The clamping mechanism for a guitar capo according to claim 1, wherein an end of the rebound torsion spring (4) away from the slider rail (2) is in contact with the unlocking handle (5), and the limiting hole (13) extends through the lower clamp (9).

6. The clamping mechanism for a guitar capo according to claim 1, wherein the lower clamp (9) has a cam structure on one side, and the bottom of the self-locking slider (7) contacts with the cam structure of the lower clamp (9) forming a cam mechanism.

7. The clamping mechanism for a guitar capo according to claim 1, wherein a sliding slot is arranged at the bottom of the slider rail (2), and the self-locking slider (7) is movably installed inside the sliding slot forming a slider mechanism.

8. The clamping mechanism for a guitar capo according to claim 1, wherein the unlocking handle (5) forming a crank slider mechanism together with the self-locking slider (7) through the crank slider pin (8), and the lower clamp (9) is movably installed at the bottom of the upper clamp (1) and below the self-locking slider (7).

9. The clamping mechanism for a guitar capo according to claim 1, wherein the limiting pin (14) is movably installed inside the limiting hole (13) on the lower clamp (9), so that the rotation range of the lower clamp (9) is limited by the size of the limiting hole (13).

10. A clamping mechanism for a guitar capo, comprising:

an upper clamp (1), the upper clamp having a slider rail (2); a crank hinge (6) disposed inside the slider rail (2), and an unlocking handle (5) having a top end (22) and a bottom end (24), said top end (22) abuts a top surface of the upper clamp (1), the unlocking handle (5) is hinged with the slider rail (2) through the crank hinge (6);

a self-locking slider (7) is movably installed at the bottom of the slider rail (2), and a crank slider pin (8) is disposed at the bottom end of the unlocking handle (5), said crank slide pin (8) is disposed adjacent the self-locking slider (7); and a lower clamp (9), the lower clamp (9) having a lower fixing pin (11) hinged inside the lower clamp (9), the lower clamp (9) having a cam structure, wherein the bottom of the self-locking slider (7) contacts with the cam structure of the lower clamp (9) forming a cam mechanism.

11. The clamping mechanism for a guitar capo according to claim 10, wherein the upper clamp (1) and the lower clamp (9) hinge about the lower fixing pin (11).

* * * * *